US005421694A

United States Patent [19]

Baker et al.

[11] Patent Number: 5,421,694

[45] Date of Patent: Jun. 6, 1995

[54] NON-CONTACTING JOYSTICK

[75] Inventors: Thomas M. Baker, Peoria, Ill.; George Codina, North Hollywood, Calif.; Larry H. Franzen, Dunlap; John F. Szentes, Peoria, both of Ill.

[73] Assignee: Caterpillar Inc., Peoria, Ill.

[21] Appl. No.: 64,301

[22] Filed: May 20, 1993

[51] Int. Cl.[6] ..... E02F 9/20

[52] U.S. Cl. ..... 414/694; 200/6 A; 74/471 XY; 414/4

[58] Field of Search ..... 414/4, 5, 680, 694; 200/600, 6 A, 4, 5 R, 61.85; 74/471 XY; 273/148 B; 345/161; 341/33

[56] References Cited

U.S. PATENT DOCUMENTS

| | | | |
|---|---|---|---|
| 4,161,726 | 7/1979 | Burson et al. | 200/6 A X |
| 4,305,007 | 12/1981 | Hughes | 307/116 |
| 4,434,412 | 2/1984 | Ruumpol | 336/134 |
| 4,489,303 | 12/1984 | Martin | 338/128 |
| 4,654,576 | 3/1987 | Oelsch et al. | 322/3 |
| 4,685,678 | 8/1987 | Frederiksen | 345/161 X |
| 4,712,376 | 12/1987 | Hadank et al. | 60/427 |
| 4,789,556 | 11/1989 | Duimel | 200/6 A X |
| 4,795,952 | 1/1989 | Brandstetter | 318/560 |
| 4,825,157 | 4/1989 | Mikan | 324/208 |
| 5,002,454 | 3/1991 | Hadank et al. | 414/695.5 |
| 5,112,184 | 5/1992 | Tapper et al. | 74/471 XY X |

FOREIGN PATENT DOCUMENTS

| | | |
|---|---|---|
| 0361666 | 4/1990 | European Pat. Off. . |
| 63-214601 | 7/1988 | Japan . |
| 325802 | 2/1930 | United Kingdom . |
| 2060173 | 4/1981 | United Kingdom . |
| 2072856 | 10/1981 | United Kingdom . |
| WO/06242 | 8/1988 | WIPO . |
| WO/09927 | 10/1989 | WIPO . |

OTHER PUBLICATIONS

Hydraulics & Pneumatics, Jun. 1988, "What's Behind That Joystock?", by: D. D. Schumann, P.E.

*Primary Examiner*—Donald W. Underwood
*Attorney, Agent, or Firm*—David M. Masterson

[57] ABSTRACT

A non-contacting joystick includes a control shaft being universally movable about a Z-axis. A spherical conducting body is attached to an end of the control shaft. A plurality of conducting plates are disposed circumjacent to the spherical body. A charging power supply supplies electrical energy of a first polarity to the spherical body and electrical energy of a second polarity to the plurality of conducting plates. Each conducting plate forms a variable capacitor with the spherical body. The capacitance value of each variable capacitor is a function of the displacement of the spherical body relative to the Z-axis. A circuit produces a plurality of position signals, each position signal being responsive to a capacitance value of a respective variable capacitor. The position signals indicate the relative position of the spherical body.

14 Claims, 8 Drawing Sheets

NON-CONTACTING JOYSTICK

TECHNICAL FIELD

This invention relates generally to a non-contacting joystick and, more particularly, to a non-contacting joystick for controlling a work implement of a machine.

BACKGROUND ART

In the field of work machines, particularly those machines which perform digging or loading functions such as excavators, backhoe loaders, and front shovels, the work implements are generally manually controlled with two or more operator controls in addition to other machine function controls. The manual control system often includes foot pedals as well as hand operated levers. There are several areas in which these types of implement control schemes can be improved to alleviate operator stress and fatigue resulting from the manipulation of multiple levers and foot pedals. For example, a machine operator is required to possess a relatively high degree of expertise to manipulate and coordinate the multitude of control levers and foot pedals proficiently. To become productive an inexperienced operator requires a long training period to become familiar with the controls and associated functions.

Some manufacturers recognize the disadvantages of having too many control levers and have adapted a two-lever control scheme as the norm. Generally, two vertically mounted joysticks share the task of controlling the linkages (boom, stick, and bucket) of the work implement. For example, Caterpillar excavators employ one joystick for stick and swing control, and another joystick for boom and bucket control. However, the two-lever control scheme presently used in the industry may still be improved to provide for better productivity.

One disadvantage of the joysticks of this type is the use of contacting switches. For example, joystick contacting switches are used to control direction of movement. However, such switches are subject to wear, necessitating switch replacement or repair. Thus, the long term cost of such joysticks is quite high. Further, when a joystick is not operating properly, the machine cannot be used. This "down-time" greatly adds unacceptable burdens to the machine owner/leasor due to time restrictions on most jobs.

Several attempts have been made to overcome the problems of contact-type joysticks. For example, the non-contacting control-handle discussed in U.S Pat. No. 4,434,412 and the control signal generator discussed in U.S. Pat. No. 4,654,576 each teach the use of inductive sensors for detecting the displacement of a control shaft from a neutral position. However, such inductive sensors are susceptible to electromagnetic interference, are complex to manufacture, and require expensive drive circuitry for operation.

Another type of non-contacting joystick is discussed in U.S. Pat. No. 4,489,303, which teaches the use of Hall effect devices to detect the position of the control shaft from a neutral position. However, Hall effect devices have problems similar to the inductive sensors discussed above. Further, this particular joystick arrangement is limited to detecting only a limited number of discrete positions of the control shaft. For example, a magnet disposed on the control shaft can actuate only one of the Hall effect switches at any particular time. Thus the resulting positional information has poor resolution leading to poor accuracy.

Further, the above devices require complex spring arrangements to "center" the control shaft to the neutral position. Over long periods of use the spring force of these complex spring arrangements may reduce, which may lead to poor repeatability. Additionally, each of the described devices only provide for two-axis detection. Thus, more than one device is needed to control the work implement in the above described machines.

The present invention is directed to overcoming one or more of the problems as set forth above.

DISCLOSURE OF THE INVENTION

In one aspect of the present invention, a non-contacting joystick includes a control shaft being universally movable about a Z-axis. A spherical conducting body is attached to an end of the control shaft. A plurality of conducting plates are disposed circumjacent to the spherical body. A power source supplies electrical energy of a first polarity to the spherical body and electrical energy of a second polarity to the plurality of conducting plates. Each conducting plate forms a variable capacitor with the spherical body. The capacitance value of each variable capacitor is a function of the displacement of the spherical body relative to the Z-axis. A circuit produces a plurality of position signals, each position signal being responsive to a capacitance value of a respective variable capacitor. The position signals are indicative of the relative position of the spherical body.

In another aspect of the present invention, a non-contacting joystick controls a work implement on a machine. The joystick includes a control shaft that is universally movable about a Z-axis and a spherical conducting body that is attached to an end of the control shaft. A plurality of conducting plates is disposed circumjacent to the spherical body. A power source supplies electrical energy of a first polarity to the spherical body and electrical energy of a second polarity to the plurality of conducting plates. Advantageously, each conducting plate forms a variable capacitor with the spherical body. The capacitance of each variable capacitor is a function of the displacement and direction of the spherical body relative to the Z-axis. A circuit produces a plurality of position signals corresponding to the capacitance values of the variable capacitors. The position signals are indicative of the relative position of the spherical body. A microprocessor delivers a plurality of work implement control signals to the actuating means in response to receiving the position signals. An actuating device responsively moving the work implement proportional to the displacement and direction of the control shaft relative to the Z-axis.

BRIEF DESCRIPTION OF THE DRAWINGS

For a better understanding of the present invention, reference may be made to the accompanying drawings in which.

BEST MODE FOR CARRYING OUT THE INVENTION

Figure 1:
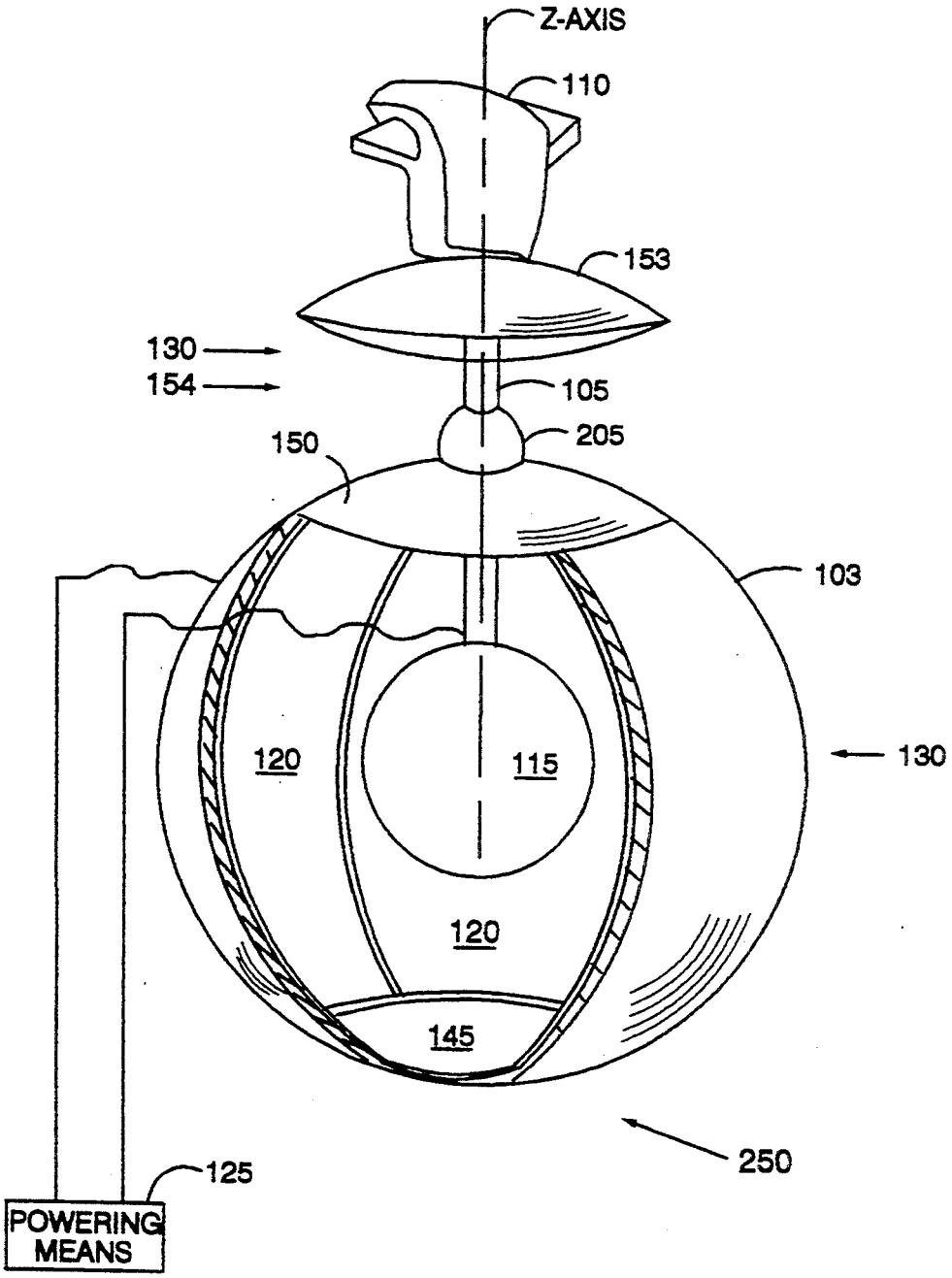
FIG. 1 shows a longitudinal section of a non-contacting joystick associated with an embodiment of the present invention.

Referring now to the drawings, wherein a preferred embodiment of the present invention is shown, FIG. 1 illustrates a non-contacting joystick 100. The joystick 100 includes a spherical housing 103 that is composed of a non-conductive material. A control shaft 105 extends through the spherical housing 103 and is universally movable about a Z-axis. An operator handle 110 is attached to one end of the control shaft 105 and a spherical conducting body 115 is attached to the other end of the control shaft 105. The control shaft 105 and operator handle 110 are preferably made of a non-conductive material.

A plurality of conducting plates 120 are affixed to the inner surface of the housing 103, circumjacent to the spherical body 115. Preferably the conducing plates 120 have a spherical shape. Each conducting plate 120 forms a variable capacitor 130 with the spherical body 115. The capacitance of each variable capacitor 130 is a function of the displacement of the spherical body 115 relative to the Z-axis.

A powering means 125 supplies electrical energy of a first polarity to the spherical body 115 and electrical energy of a second polarity to the plurality of conducting plates 120. The powering means 125 may include a 5 or 24 volt power supply, for example.

An electromagnet means 250 is provided to produce an electromagnetic force that restores the shaft 105 to a horizontal neutral position (alignment with the Z-axis) once the operator releases the control handle 110. The electromagnetic means 250 will be described infra.

It should be noted that the housing 103 may be filled with a fluid, such as hydraulic oil, to provide for desirable damping characteristics.

Figure 2:
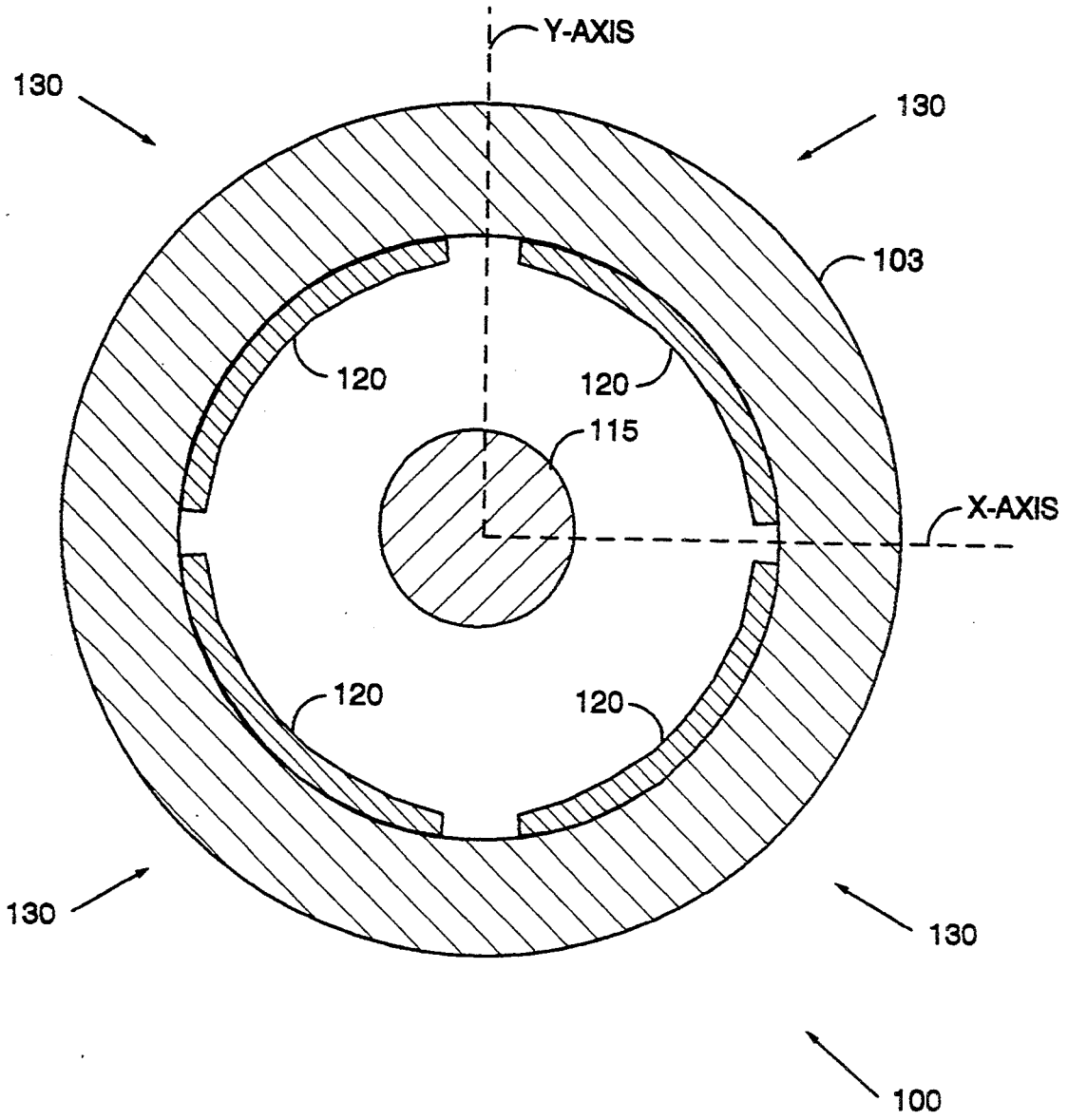
FIG. 2 shows a cross sectional view of the joystick taken about a spherical conducting body.

Illustrated in FIG. 2, is a cross sectional view of the joystick 100 taken about the spherical body 115. As shown, two orthogonal X and Y axis defines an X-Y plane that is perpendicular to the Z-axis. Four conducting plates 120 are arranged in a circular array and are spaced at substantially 90° intervals that divides the X-Y plane into four quadrants. Each of the four conducting plates 120 form a respective variable capacitor 130 with the spherical body 115. The capacitance value associated with each of the four variable capacitors 130 represents the displacement of the spherical body 115 relative to a predetermined quadrant of the X-Y plane.

Figure 3:
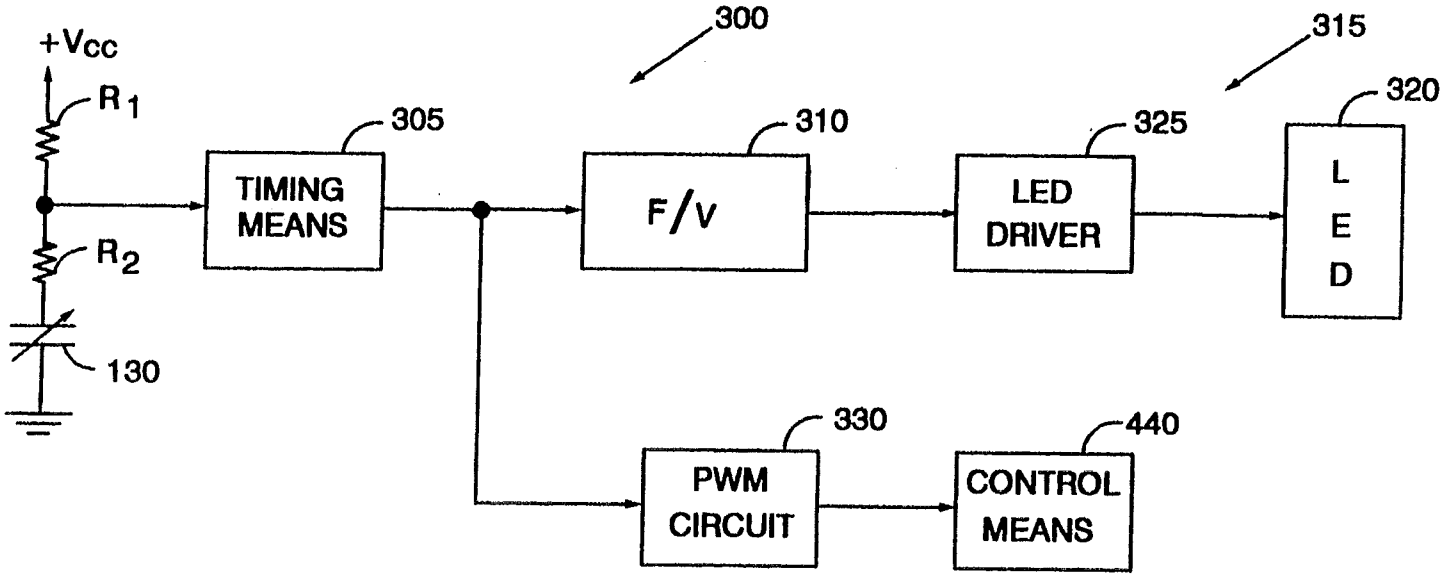
FIG. 3 shows a block diagram of an electronic circuit associated with the present invention.

Illustrated in FIG. 3, is a block diagram of a distinguishing means 300. The distinguishing means 300 produces a plurality position signals, each position signal is representative of a capacitance value of a respective variable capacitor 130. The distinguishing means 300 includes a timing means 305 that produces a position signal in frequency modulation form. The frequency of the position signal is responsive to the capacitance value of a respective variable capacitor 130. More particularly, the position signal frequency is a function of an RC time constant given by the capacitor 125 and resistors $R_1$,$R_2$. Thus, the position signal is indicative of the relative position of the spherical body 115. The timing means 305 may include a LM555 timer circuit manufactured by National Semiconductor.

Figure 4:
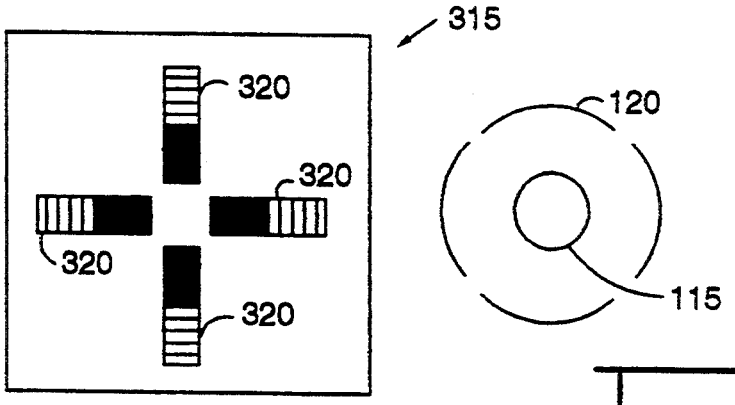
FIGS. 4, 5, and 6 show an operator display that represents the position of the joystick.
Figure 5:
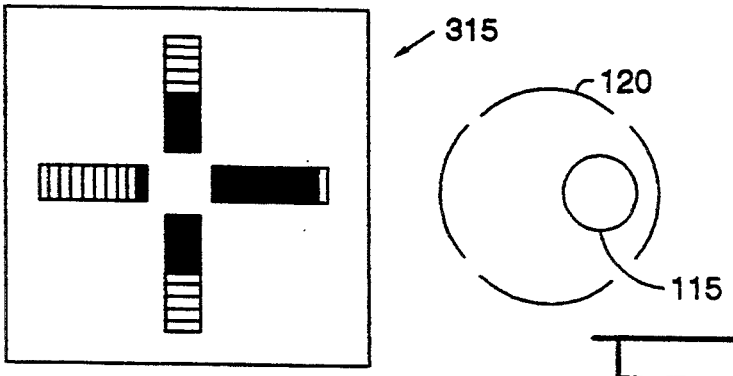
Figure 6:
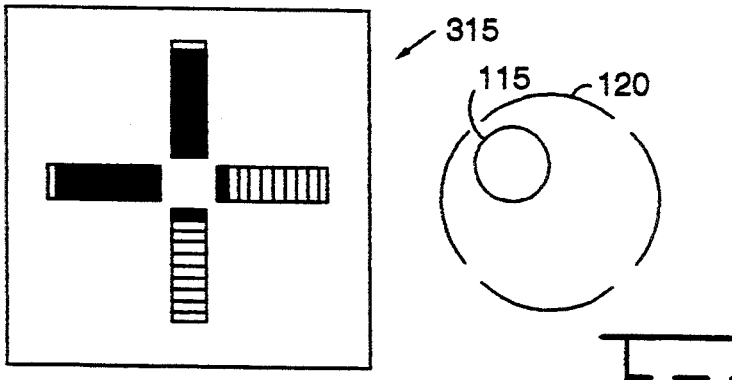

A displaying means 315 receives the position signal and responsively transforms the electrical waveform into a visual display that illustrates the position of the spherical body 115 relative to a predetermined quadrant of the X-Y plane. This is shown more particularly in FIG. 4. In FIG. 4, the displaying means 315 illustrates that the spherical body 115 is positioned at the centered position (the control shaft 105 being aligned with the Z-axis). In FIG. 5, the displaying means 315 illustrates the relative position of the spherical body 115 with respect to the X-Y plane. In FIG. 6, the displaying means 315 illustrates another position of the spherical body 115 relative to the X-Y plane. The configuration of the displaying means 315 is shown for illustrative purposes only. As is apparent, the displaying means 315 may include a variety of configurations.

Adverting back to FIG. 3, the display means 315 may include a Frequency to Voltage (F/V) convertor 310 that receives the frequency modulated position signal and converts the position signal into a voltage level signal. For example, the F/V convertor 310 may include an LM 2917 I.C. manufactured by National Semiconductor. The voltage level signal is delivered to an LED driver 315, which drives an LED display 320. As shown of FIGS. 4, 5, 6 the display means 315 includes four LED displays. For example, the LED driver circuit 320 may be manufactured by National Semiconductor as model no. LM3914, while the 10-segment LED display may be provided by Hewlitt Packard as model no. HLCP-J100. Although an LED display is shown, it may be apparent to those skilled in the art that other types of display devices may readily be substituted.

Figure 7:
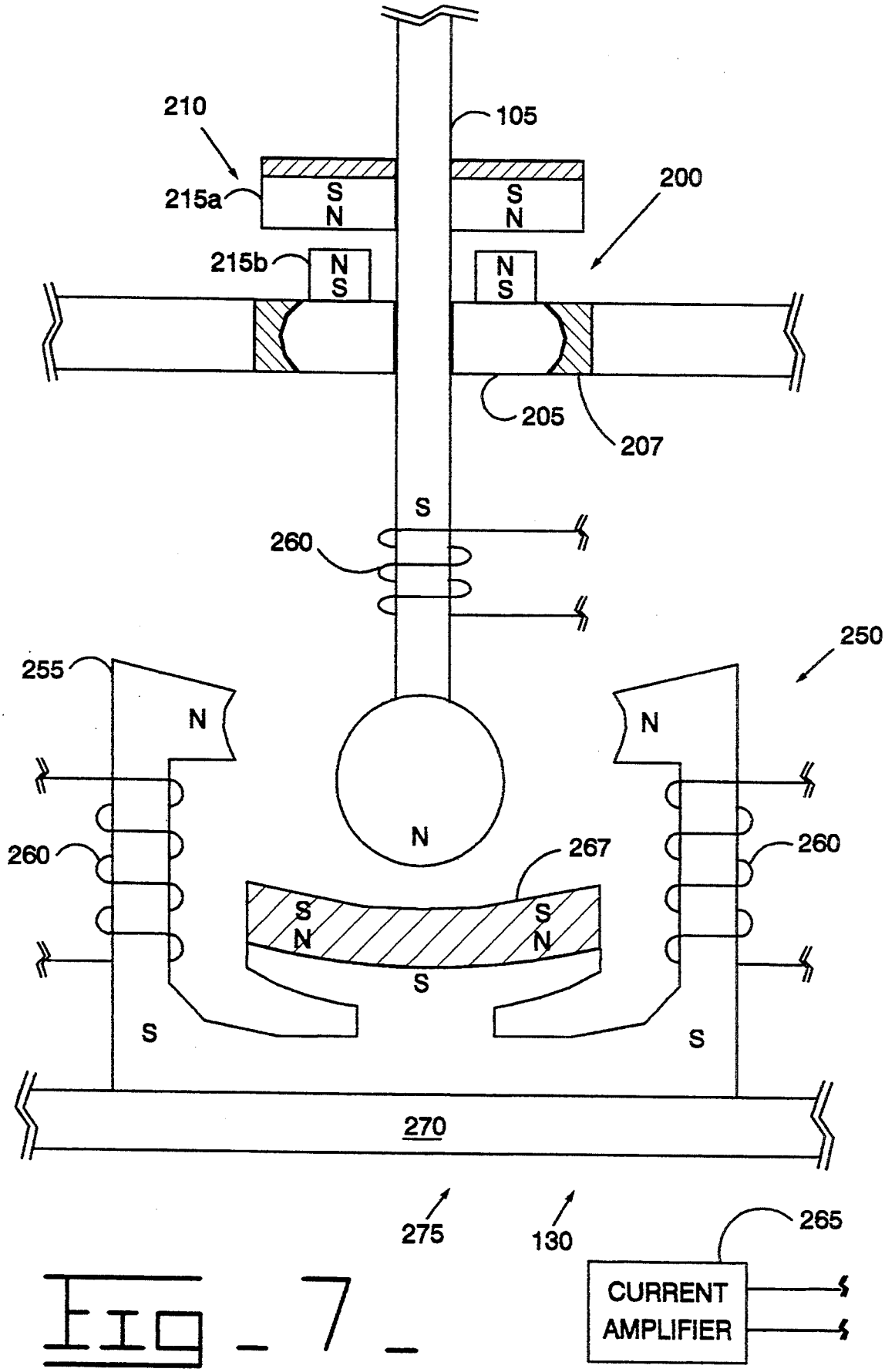
FIG. 7 shows a mechanical bearing, permanent magnet and electromagnet assemblies associated with the present invention.

The joystick 100 may have vertical movement. Shown in FIG. 7 is a mechanical bearing assembly 200 that provides for vertical and pivotal movement to the shaft 105. The mechanical bearing assembly 200 includes a bearing 205, which is "press-fit" into a bearing retainer 207. The bearing 205 defines a bore for receiving the shaft 105. The shaft 105 has limited, vertical movement relative to the bearing 205.

A magnetic assembly 210 provides a magnetic force to position the shaft 105 to a vertical neutral position (alignment of the spherical body 115 with the X-Y plane). The magnetic assembly 210 includes a plurality of ring permanent magnets. As shown, two ring magnets 215*a,b* are disposed around the shaft 105. One ring magnet 215*a* is affixed to the shaft 105, while another ring magnet 215*b* is affixed to the bearing 205. The poles of the magnets 215 are oriented as shown. The resulting permanent magnetic force provides the necessary force to center the shaft 105 at the vertical neutral position in response to the operator releasing the handle 110. It should be noted that the joystick 100 may include physical stops (not shown) to limit the vertical motion of the shaft 105.

As shown, a fifth conducting plate 270 is provided to aid in the detecting the vertical movement of the spherical body 115 along the Z-axis. The fifth conducting plate 270 is orientated parallel to the X-Y plane and has a spherical shape. The fifth conducting plate 270 forms a fifth variable capacitor 275 with the spherical body 115. The capacitance value of the fifth variable capacitor 275 is a function of the vertical movement of the spherical body 115 along the Z-axis.

The electromagnetic means 250 is now shown in greater detail with reference to FIG. 7. The electromagnetic means 250 produces an electromagnetic force that positions the shaft 105 at the horizontal neutral position (in response to the operator releasing the handle 110). Further, the electromagnetic force produced by the electromagnetic means 250 aids in centering the shaft at the vertical neutral position. The electromagnetic means 250 includes a magnetic structure 255 and a plurality of coils 260 adapted to carry electrical energy. Preferably the magnetic structure 255 has a contour shape as shown. A current amplifier 265 energizes the coils 260 to produce an electromagnetic field having the noted polarity. It is noted that the lower end of the shaft 105 should be composed of a magnetic material.

A permanent magnet 267 may be included to enhance the electromagnetic force. In the event that the electromagnet 250 is rendered inoperable, the permanent magnet 267 may provide the necessary restoring force to position the shaft 105 to the horizontal neutral position.

Finally the joystick 100 may have rotational movement. Accordingly, the mechanical bearing assembly 200 may provide for rotational movement of the shaft 105. Adverting back to FIG. 1, sixth and seventh conducting plates 150,153 are included to aid in detecting the rotational movement of the shaft 105. The sixth and seventh conducing plates 150,153 form a variable capacitor 154, which capacitance changes in response to the shaft 105 rotating about the Z-axis. The sixth and seventh conducting plates 150,153 each have a spherical shape and are opposite in polarity. As shown, the sixth conducting plate 150 is affixed to the housing 103, while the seventh conducting plate 153 is affixed to and rotates with the shaft 105 (the seventh conducting plate 153 may be formed integral with the handle 110).

Figure 8:
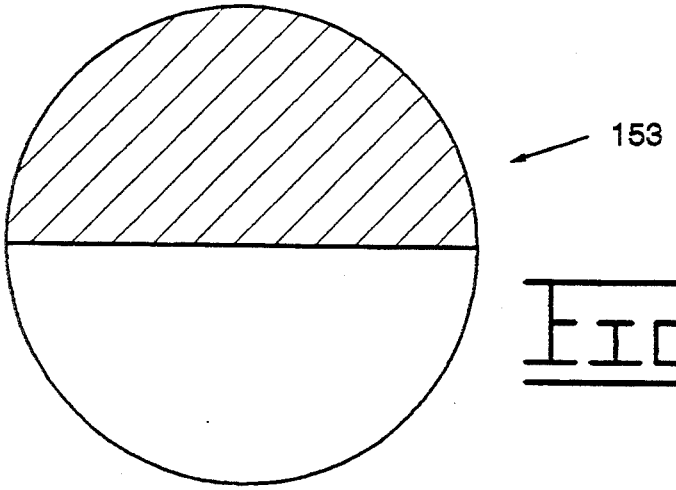
FIGS. 8, 9, and 10 show representative patterns on the surfaces of the conducting plates associated with the present invention.
Figure 9:
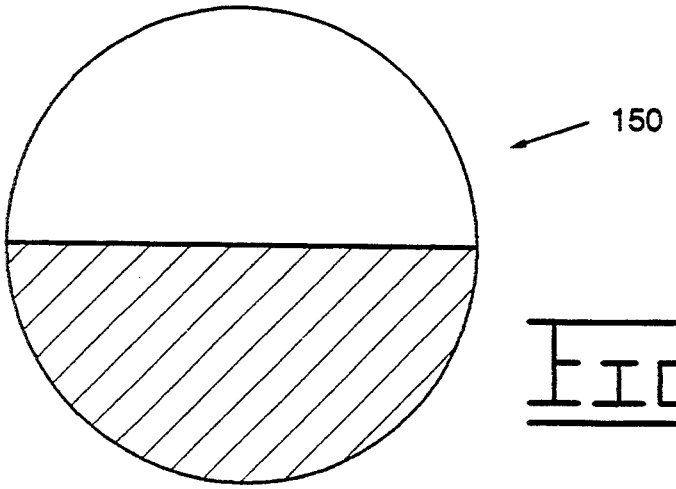
Figure 10:
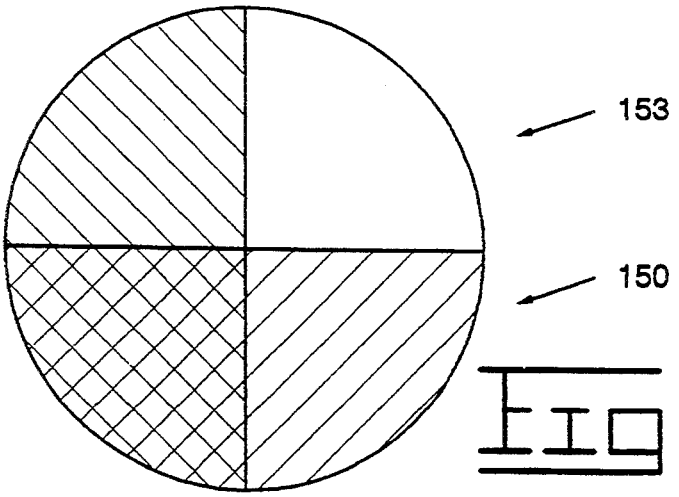

The sixth and seventh conducting plates 150,153 may be made from a non-conductive material that is partially layered with a conductive material. For example, the conductive material may be bonded to the non-conductive material to form a pattern on the conducting plate. The formed pattern may enhance capacitive changes due to rotation of the shaft 105. For example, shown in FIG. 8, half of the adjacent surfaces of the sixth and seventh conducting plates 150,153 are layered with a conductive material (shown by the diagonal hatching). The pattern of the seventh conducting plate 153 is shown in FIG. 8, while the pattern of the sixth conducting plate 150 is shown in FIG. 9. The capacitance change will thus be responsive to the superimposed pattern on the conducting plates. An example of a superimposed pattern is shown in FIG. 10, which represents a 90° rotation of the shaft 105. Those skilled in the art will recognize that a variety of such pattern may be used to enhance detectable changes in capacitance. The particular pattern shown is not critical to the present invention.

It should be noted that the capacitance value associated with the sixth and seventh plates 150,153 not only is responsive to the rotational motion of the shaft 105 but also to the vertical motion of the shaft 105. Thus the positional data associated with the capacitance value of the sixth and seventh plates 150,153 should be modified in response to the positional data representative of the vertical motion of the shaft 105. This modification is best performed by a microprocessor based system.

INDUSTRIAL APPLICABILITY

The operation of the present invention is best described in relation to its use in the control of work implements on machines, particularly those machines which perform digging or loading functions such as excavators, backhoe loaders, and front shovels.

Figure 11:
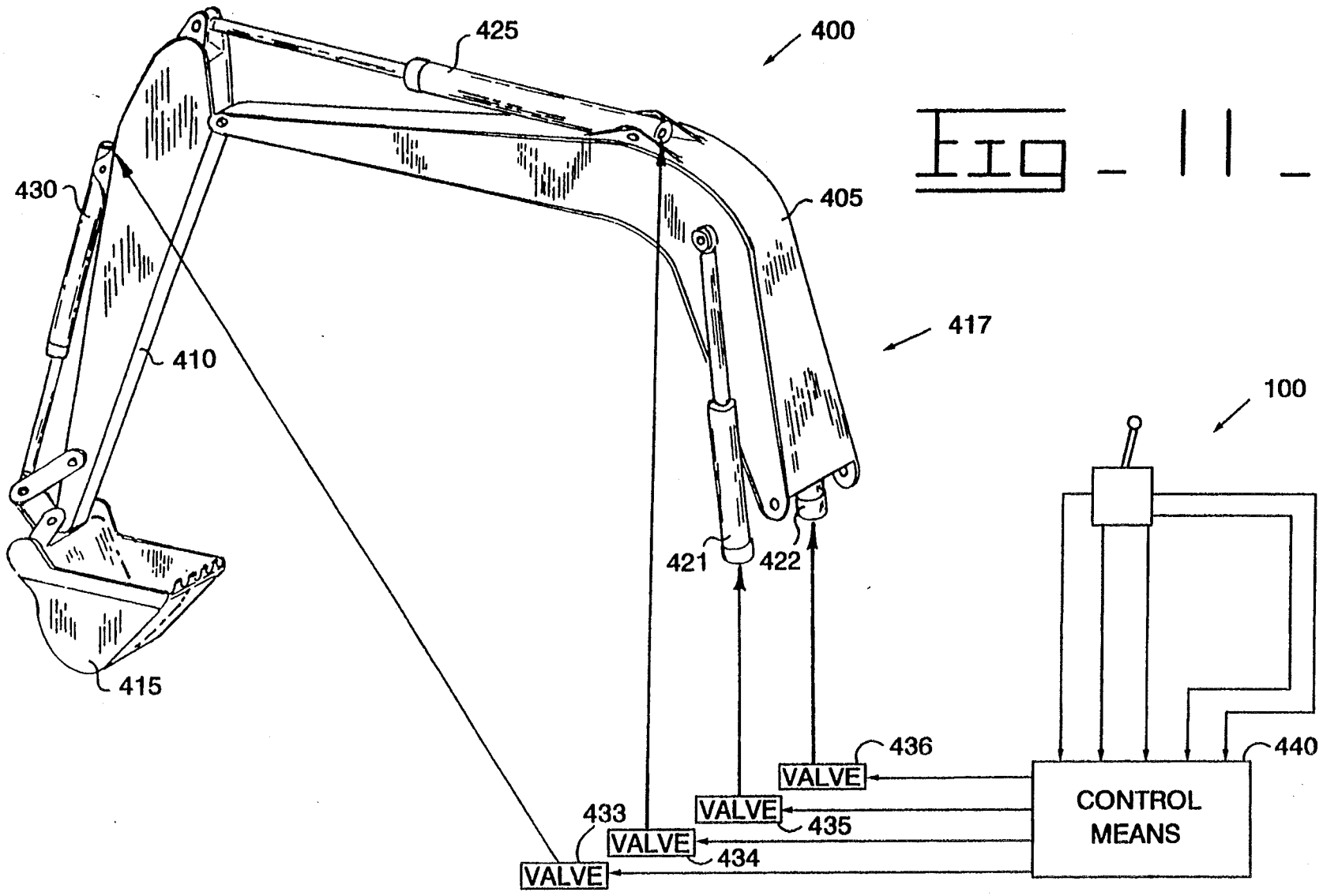
FIG. 11 shows a diagrammatic view of a control system of the present invention in conjunction with a work implement.

Referring to FIG. 11, a work implement 400 under control typically consists of linkages such as a boom 405, stick 410, and bucket 415. The linkages are actuatable via an actuating means 417. The actuating means 417 may include a hydraulic cylinder, electro-magnetic actuator, piezoelectric actuator, or the like.

The implement configuration may vary from machine to machine. In certain machines, such as the excavator, the work implement is rotatable along a machine center axis. Here, the work implement 400 is generally actuated in a vertical plane, and swingable through a horizontal plane by rotating on a machine platform or swinging at a pivot base on the boom 405. The boom 405 is actuated by two hydraulic cylinders 421,422 enabling raising and lowering of the work implement 400. The stick 410 is drawn inward and outward from the machine by a hydraulic cylinder 425. Another hydraulic cylinder 430 "opens" and closes"the bucket 415. The hydraulic flow to the hydraulic cylinders are regulated by hydraulic control valves 433,434,435,436.

The operator interface for the control of the work implement 400 consists of only one joystick 100. Advantageously, the joystick 100 has "four" axis of movement: for example, pivotal movement relative to the Z-axis in the X-Y plane, vertical movement up and down along the Z-axis, and rotational movement about the Z-axis. The joystick 100 generates at least one position signal for each respective axis of movement, each signal representing the joystick displacement direction and velocity from the Z-axis. The position signals are received by a control means 440, which responsively delivers a plurality of work implement control signals to the hydraulic control valves 433,434,435,436.

For example, with reference to FIG. 3, the timing means 305 delivers the position signal to a Pulse Width Modulation (PWM) converting circuit 330, which converts the position signal having frequency modulated form into PWM form in a well known manner. The PWM position signal is then delivered to the control means 440. Preferably, the control means 440 is a microprocessor based system.

Figure 12:
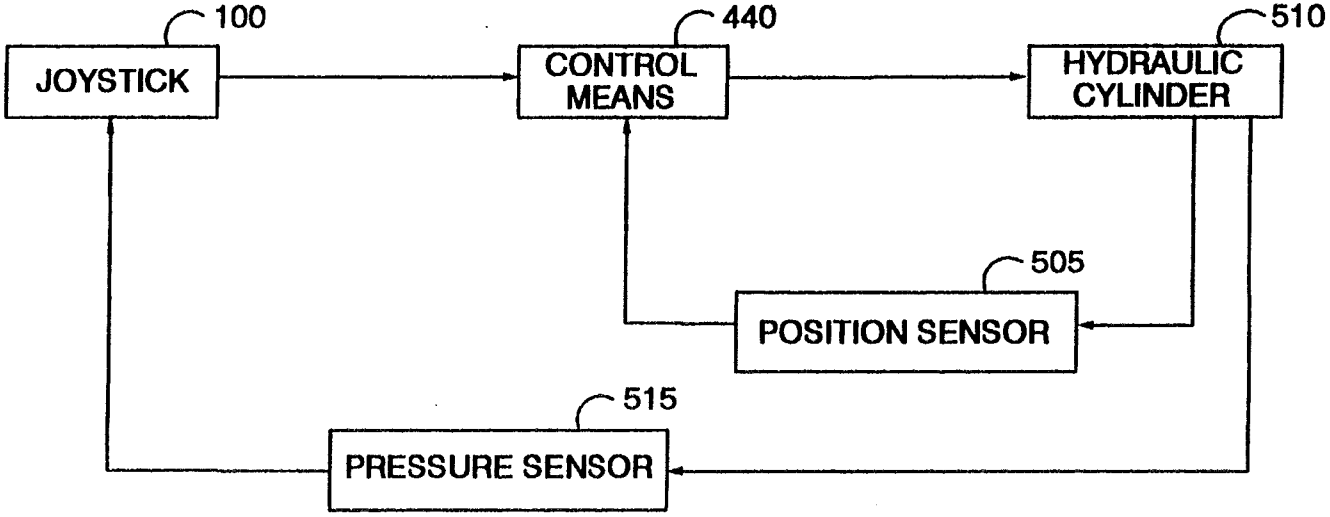
FIG. 12 shows a block diagram of a control scheme associated with the present invention.

Referring now to FIG. 12, a block diagram of the joystick control is shown. The joystick 100 produces a plurality of position signals, each position signal is indicative of a desired velocity of the work implement 400. The position signals are delivered to the control means 440. The position signals are representative of Cartesian coordinates corresponding to the joystick axes of movement. The control means 440 also receives linkages position data from sensors 505 such as linkage angle resolvers or RF cylinder position sensors such as known in the art. The control means 440 may transform the representative Cartesian coordinates into another coordinate system based on the configuration and position of the linkages. Please refer to *Robot Manipulators: Mathematics, Programming and Control* by Richard P. Paul, MIT Press, 1981. Further, the reader referred to FIG. 4 and the associated description of the Cartesian to linkage coordinate transformations in U.S. Pat. No.

5,002,454 issued to Hadank et al., which is hereby incorporated by reference. It also may be desirable to utilize proportional flow control. This involves calculating for the amount of hydraulic flow available for implement actuation under the current operating conditions, e.g. engine speed, machine travel, etc. Proportional hydraulic flow control is discussed in U.S. Pat. No. 4,712,376 also issued to Hadank et al., which is hereby incorporated by reference.

The joystick 100 controls the work implement 400 in the following manner. The joystick 100 produces a first set of position signals that correspond to the horizontal movement of the control shaft 105 along the X-Y plane. The control means 440 receives the first set of position signals and delivers a plurality of work implement control signals to the respective hydraulic cylinders to produce a vertical motion of the boom 405 proportional to the direction of movement of the control shaft 105 along the X-axis. Further a horizontal motion of the stick 410 is produced proportional to the movement of the control shaft 110 along the Y-axis.

The joystick 100 produces a second set of position signals corresponding to the vertical motion of the control shaft 105 along the Z-axis. The control means 440 delivers a work implement control signal to the hydraulic cylinder 430 in response to receiving the second set of position signals. This produces a curling motion of the bucket 415 proportional to the magnitude and direction of the movement of the control shaft 105 along the Z-axis.

The joystick 100 produces a third set of position signals corresponding to the rotational direction of the control shaft 105 about the Z-axis. The control means 440 receives the third signals and responsively delivers a plurality of work implement control signals to the actuating means 417. This produces a swing motion of the work implement 400 proportional to the rotational movement of the control shaft 105 about the Z-axis.

It may be desirable to provide the operator with pressure feedback. For example as shown in FIG. 12, a pressure sensor 515 senses the hydraulic fluid pressure imposed on the hydraulic cylinder and responsively produces a pressure signal having a magnitude proportional to the sensed fluid pressure. The current amplifier 265 receives the pressure signal and responsively produces an energization signal having a magnitude proportional to the pressure signal magnitude. In response to receiving the energization signal the electromagnet 250 produces an electromagnetic force in proportion to the magnitude of the energization signal. The electromagnetic force opposes the operator force that displaces the spherical body 115 to give the operator a feedback of the force imposed on the work implement. Thus the operator is provided with a "feel" of the machine performance to enhance his work efficiency.

The above discussion primarily pertains to excavator or excavator type machines; however, it may be apparent to those skilled in the art that the present invention is well suited to other types work implement configurations that may or may not be associated with work machines.

Other aspects, objects and advantages of the present invention can be obtained from a study of the drawings, the disclosure and the appended claims.

We claim:

1. A non-contacting joystick, comprising:

a control shaft;

a housing;

means for universally, pivotally mounting the control shaft to the housing;

a spherical conducting body being attached to an end of the control shaft;

a plurality of conducting plates being disposed circumjacent to the spherical body;

powering means for supplying electrical energy of a first polarity to the spherical body and electrical energy of a second polarity to the plurality of conducting plates, each conducting plate forming a variable capacitor with the spherical body, the capacitance value of each variable capacitor being a function of the displacement of the spherical body relative to a centered position; and distinguishing means connected to the capacitors for producing a plurality of position signals, each position signal being responsive to a capacitance value of a respective variable capacitor.

2. A non-contacting joystick, as set forth in claim 1, including two orthogonal X and Y axis for defining an X-Y plane, and being further characterized by four conducting plates that are spaced at substantially 90° intervals dividing the X-Y plane into four quadrants, the four conducting plates forming four respective variable capacitors with the spherical body, the capacitance value associated with each of the four variable capacitors representing the displacement of the spherical body relative to a predetermined quadrant of the X-Y plane.

3. A non-contacting joystick, as set forth in claim 2, wherein the distinguishing means includes:

a timing means for producing a position signal having a frequency modulation, the frequency of the position signal being a function of the capacitance value of a respective variable capacitor; and a displaying means for receiving the position signal and responsively transforming the position signal into information representing a visual indication of the position of the spherical body relative to predetermined quadrants of the X-Y plane.

4. A non-contacting joystick, as set forth in claim 2, including a Z-axis that extends through the intersection point of the X and Y axis, wherein the mounting means further provides the control shaft with movement along the Z-axis, and including a fifth conducting plate being oriented parallel to the X-Y plane, the fifth conducting plate forming a fifth variable capacitor with the spherical body, the capacitance value of which is a function of the movement of the spherical body along the Z-axis.

5. A non-contacting joystick, as set forth in claim 4, including a permanent magnet means for producing a magnetic force that positions the shaft to both a vertical and a horizontal neutral position and an electromagnetic means for producing an electromagnetic force that positions the shaft to a horizontal neutral position.

6. An apparatus for controlling a work implement on a machine, the work implement being movable by an actuating means, comprising:

a control shaft;

a housing;

means for universally, pivotally mounting the control shaft to the housing;

a spherical conducting body being attached to an end of the control shaft;

a plurality of conducting plates being disposed circumjacent to the spherical body;

power means for supplying electrical energy of a first polarity to the spherical body and electrical energy of a second polarity to the plurality of conducting plates, each conducting plate forming a variable capacitor with the spherical body, the capacitance of each variable capacitor being a function of the displacement and direction of the spherical body relative to a centered position;

means connected to the capacitors for producing a plurality of position signals corresponding to the capacitance values of the variable capacitors; and control means for delivering a plurality of work implement control signals to the actuating means in response to receiving the position signals, the actuating means responsively moving the work implement proportional to the displacement and direction of the control shaft relative to the central position.

7. An apparatus, as set forth in claim 6, wherein the work implement includes:

a boom pivotally connected to the machine;

a stick pivotally connected to the boom; and a bucket pivotally connected to the stick, wherein the boom, stick, and bucket each includes respective actuating means for independent movement.

8. An apparatus, as set forth in claim 7, including two orthogonal X and Y axis for defining an X-Y plane, and being further characterized by four conducting plates that are spaced at substantially 90° intervals dividing the X-Y plane into four quadrants, the four conducting plates forming four respective variable capacitors with the spherical body, the capacitance value associated with each of the four variable capacitors representing the displacement of the spherical body relative to a predetermined quadrant of the X-Y plane.

9. An apparatus, as set forth in claim 8, including means for producing a first see of position signals corresponding to the pivotal movement of the control shaft, and wherein the control means delivers a plurality of work implement control signals to the actuating means in response to receiving the first set of position signals to produce a vertical motion of the boom proportional to the direction of movement of the spherical body along the X-axis, and a horizontal motion of the stick proportional to the movement of the spherical body along the Y-axis.

10. An apparatus, as set forth in claim 9, including a Z-axis that extends through the intersection point of the X and Y axis, wherein the mounting means provides the control shaft with movement along the Z-axis, and including a fifth conducting plate being oriented parallel to the X-Y plane, the fifth conducting plate forming a fifth variable capacitor with the spherical body, the capacitance value of which is a function of the movement of the spherical body along the Z-axis.

11. An apparatus, as set forth in claim 10, including means for producing a second set of position signals corresponding to the motion of the control shaft along the Z-axis, and wherein the control means delivers a work implement control signal to the actuating means in response to receiving the second set of position signals to produce a curling motion of the bucket proportional to the magnitude and direction of the movement of the spherical body along the Z-axis.

12. An apparatus, as set forth in claim 11, wherein the control means adjusts the magnitude of the plurality of work implement control signals so that the velocity of displacement of the boom, stick, and bucket is proportional to the magnitude of displacement of the control shaft.

13. An apparatus, as set forth in claim 12, wherein the actuating means of the boom, stick, and bucket each include:

a hydraulic cylinder; and sensor means for sensing the hydraulic fluid pressure imposed on the hydraulic cylinder and responsively producing a pressure signal having a magnitude proportional to the sensed fluid pressure.

14. An apparatus, as set forth in claim 13, including:

means for receiving the pressure signal and responsively producing an energization signal having a magnitude proportional to the pressure signal magnitude; and an electromagnet for receiving the energization signal and producing an electromagnetic force proportional to the magnitude of the pressure signal that opposes the displacing force of the spherical body.

* * * * *

UNITED STATES PATENT AND TRADEMARK OFFICE

CERTIFICATE OF CORRECTION

PATENT NO. : 5,421,694

DATED : June 6, 1995

INVENTOR(S) : Thomas M. Baker et al.

It is certified that error appears in the above-identified patent and that said Letters Patent is hereby corrected as shown below:

In column 9, claim 9, line 2, "see" should be --set--.

Signed and Sealed this

Fifth Day of September, 1995

*Attest:*

*Attesting Officer*

BRUCE LEHMAN

*Commissioner of Patents and Trademarks*